US006766561B1

(12) United States Patent
Cheng

(10) Patent No.: US 6,766,561 B1
(45) Date of Patent: Jul. 27, 2004

(54) FRAMELESS GLASS DOOR HINGE

(76) Inventor: Ko-Ming Cheng, No. 9-60, Hsi-Liao Rd., Hsi-Liao Village, Ta-Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 10/402,065

(22) Filed: Mar. 28, 2003

(51) Int. Cl.[7] ..... E05D 7/04

(52) U.S. Cl. ..... 16/235; 16/252; 16/382; 16/286; 16/332; 16/245

(58) Field of Search ..... 16/235, 238, 240, 16/245, 246, 252, 382, 334, 335, 332, 286; 4/607, 557, 614; 49/397, 399, 381; 160/213, 210, 206, 199

(56) References Cited

U.S. PATENT DOCUMENTS 4,159,557 A * 7/1979 Pittasch et al. ..... 16/237
4,411,045 A * 10/1983 Rock et al. ..... 16/243
4,506,409 A * 3/1985 Lautenschlager ..... 15/238
5,339,493 A * 8/1994 MacIntyre ..... 16/238
5,500,983 A * 3/1996 Lautenschlager ..... 16/304
5,713,105 A * 2/1998 Toomey ..... 16/245
5,799,370 A * 9/1998 Davidian et al. ..... 16/236
5,867,869 A * 2/1999 Garrett et al. ..... 16/252
6,070,294 A * 6/2000 Perkins et al. ..... 16/252
6,704,966 B1 * 3/2004 Kao ..... 16/252

FOREIGN PATENT DOCUMENTS

DE 19829017 C1 * 7/1999 ..... E05D/7/04
EP 1319359 A2 * 6/2003 ..... A47K/3/36

* cited by examiner

*Primary Examiner*—Chuck Mah
(74) *Attorney, Agent, or Firm*—William E. Pelton, Esq.

(57) ABSTRACT

A frameless glass door hinge has a mounting device, an internal doorstop, an angle adjustment device and a hinge assembly. The adjusting device has a setscrew, an adjustment block and a lock with a striated front surface. The internal doorstop has coil springs, two holders, a stop rod with a central portion and a head. The head has detents and a striated surface. The hinge body has a right hinge leaf, a left hinge leaf and two rubber seals. The mounting device has a doorstop bracket, a bracket leaf and a central hinge pin. The doorstop bracket is mounted on the bracket leaf, and the head is mounted in doorstop bracket by a bushing and the central hinge pin. The central portion of the stop rod abuts a detent in the head, and the stop rod is securely mounted in the right hinge leaf.

14 Claims, 8 Drawing Sheets

FRAMELESS GLASS DOOR HINGE

BACKGROUND OF THE INVENTION

1. Field of the Invention

The present invention relates to a hinge, and more particularly to a frameless glass door hinge that can adjust a glass door in a transverse direction.

2. Description of Related Art

With reference to FIG. 8, a conventional frameless glass door hinge comprises a mounting device (50), a hinge assembly (60), an adjusting device (70) and an internal doorstop (80).

The mounting device (50) comprises a bracket leaf (51), threaded bolts (not numbered), a doorstop bracket (52), a central hinge pin (53) and a bushing (not numbered). The bracket leaf (51) comprises a front surface (not numbered), a rear surface (not numbered) and through holes (not numbered). The rear surface has an inside edge (not numbered), a recess (511) and an elongated recess hole (5111). The recess (511) extends into the rear surface of the bracket leaf (51) from the inside edge, and the elongated recess hole (5111) extends through the bracket leaf from the recess (511).

The doorstop bracket (52) comprises a bracket body (not numbered) and two ears (522). The doorstop bracket (52) has a rear rectangular surface (not numbered), a rectangular recess (524) and a rectangular through hole (not numbered). The rectangular recess (524) is formed in the rear surface of the bracket body and communicates with the recess (511) in the bracket leaf (51). The bracket leaf (51) is formed on the bracket body of the doorstop bracket (52). The rectangular through hole extends from the rectangular recess (524) through the bracket body. The bracket body extends forward and forms two ears (522) with a head gap (521) formed between the two ears (522). A pivot hole (523) passes vertically through both ears (522).

The bushing has an upper segment (not numbered) and a lower segment (not numbered). Each segment has an end flange (not numbered) and a hollow shaft (not numbered), and the hollow shafts of the two segments are mounted in the pivot holes (523) respectively such that the hollow shafts face each other. The central hinge pin (53) is a cylindrical shaft and has an upper end (not numbered) and a lower end (not numbered). Flutes (not numbered) are formed on the upper end of the central hinge pin (53).]

The adjusting device (70) comprises a key (71) and a bolt (73). The key (71) has a rectangular end (not numbered), a round end (not numbered), a rectangular through hole (not numbered) and a threaded hole (711). The rectangular through hole (not numbered) extends through the rectangular end of the key (71), and the threaded hole (711) extends through the round end of the key (71). When the key (71) is slid into the recesses (511, 524) in the mounting device (50), the threaded hole (711) in the key (71) aligns with and can be adjusted in the elongated recess hole (5111). The bolt (73) extends through the elongated recess hole (5111) and screws into the threaded hole (711) from the front surface of the bracket leaf (51) to hold the key (71) in place.

The internal doorstop (80) comprises a head (81), two coil springs (83), two holders (84) and a stop rod (85). The head (81) comprises a central pivot hole (811), a round surface (not numbered), detents (812) and a neck (813). The central pivot hole (811) extends vertically through the head (81) and aligns with the pivot holes (523) through the ears (522) on the mounting device (50). The detents (812) are formed in the round surface parallel to the central pivot hole (811). When the head (81) is mounted in the head gap (521) between the ears (522) of the doorstop bracket (52), the bushing segments extending through the pivot holes (523) extend into the central pivot hole (811). The central hinge pin (53) extends through the bushing and holds the head (81) in the head gap (523) between the ears (522). The neck (813) of the head (81) extends through the rectangular through hole and recess (524) in the body of the doorstop bracket (52) and the rectangular hole in the key (71). The key (71) holds the head (81) firmly in position. A gap (not shown) is formed between the head (81) and the doorstop bracket (52) so the head (81) will pivot around the central hinge pin (53) when the key (71) is loosened.

The stop rod (85) has two ends (not numbered). Each holder (84) has a shaft (not numbered) and a head (not numbered). Each head has a distal end (not numbered) and a transverse mounting slot (not numbered) radially extending from the transverse head. The shafts of the holders (84) are mounted respectively in the coil springs (83), and the two ends of the stop rod (85) are mounted respectively in the transverse mounting slots in the holders (84). The stop rod (85) presses against the outside surface of the head (81) and is held selectively in one of the detents (812).

The hinge assembly (60) has a right hinge leaf (62), a left hinge leaf (61) and threaded bolts (not numbered). The right hinge leaf (62) comprises two arms (not numbered), an outer surface (not shown), an inside surface (not numbered), a hollow stud (623), a U-shaped gap (not numbered) and a doorstop bracket (622). The hollow stud (623) protrudes from the inside surface and has an inner threaded hole (not numbered). The U-shaped gap (not numbered) is formed between the two arms of the right hinge leaf (62). The doorstop bracket (622) comprises a central body (not numbered) and two flat arms (not numbered). The central body has a transverse threaded hole (not numbered), a right hinge leaf recess (224). The right hinge leaf recess (624) has a rectangular space (not numbered) and two cylindrical spaces (not numbered). The two coil springs (83) are mounted respectively in the cylindrical spaces in the right hinge leaf recess (624). The holders (84) are mounted respectively in the cylindrical spaces of the right hinge leaf recess (624). The two flat arms of the doorstop bracket (622) are formed parallel to and respectively abut the two arms of the right hinge leaf (62). Two hinge pin holes (625) extend through the two flat arms of the bracket (622) respectively. The ends of the central hinge pin (53) are securely held in the hinge pin holes (625) by the flutes on one end of the central hinge pin (625).

The left hinge leaf (61) comprises an inside surface (not shown), an outer surface (not numbered), countersunk holes (612) two arms (not numbered) and a U-shaped gap (not numbered). The U-shaped gap is formed between the two arms. The countersunk holes (612) extend from the outer surface to the inside surface of the left hinge leaf (61) and correspond respectively to the threaded holes in the hollow stud (623) on the inside surface and the central body of the right hinge leaf (62). The threaded bolts are screwed into the threaded hold in the stud (623) and the central body to connect the right and left hinge leaf (62, 61) together The head (81) is connected to the hinge assembly (60) and extends into the gap between the two arms in the hinge assembly (60). The central hinge pin (53) is the pivotal center for the hinge assembly (60).

The frameless glass door hinge is attached to a doorframe (not numbered) by passing the threaded bolts through the through holes in the bracket leaf (51) and screwing the threaded bolts into threaded holes (not shown) in the doorframe. A frameless glass door (not numbered) is securely mounted between the inner surfaces of the right and left hinge leaves (62, 61). When the frameless glass door is open, the stop rod (85) is usually held in one of the detents (812) in the head (81). When the door glass is adjusted, the stop rod (85) disengages from the detent (812), and the stop rod (85) moves with the door glass on the round surface of the head (81) until the stop rod (85) engages another one of the detents (812). When the stop rod (85) engages another detent (812), the door glass stops pivoting.

When the frameless door glass is not aligned transversely with the doorframe, the threaded bolt (73) is loosened. Then the key (71) can be moved a small amount in the recess (511) in the bracket leaf (51) and the rectangular recess (524) in the body of the bracket device (50) so the internal doorstop (80) moves until the frameless glass door is aligned with the door frame. After the glass door is aligned with the doorframe, the threaded bolt (73) is screwed tightly into the threaded hole (711) in the key (71) to hold the key (71) in the recesses (524, 511). The head (81) is tightly held in the doorstop bracket (52), and the frameless door glass is free to pivot in the doorframe.

The disadvantage of the conventional frameless glass door hinge is that the key (71) has to be loosened every time the glass door needs to be adjusted transversely, which is inconvenient and tedious. To overcome the shortcomings, the present invention provides an adjusting device for a glass door hinge to mitigate or to obviate the aforementioned problems.

SUMMARY OF THE INVENTION

The primary objective of the present invention is to provide an adjusting device that is easy to access so a frameless glass door can be aligned with a doorframe in a transverse direction by a simple adjustment of a hinge assembly.

To accomplish the foregoing objective, the present invention has an angle adjusting device and an internal doorstop that can be adjusted a small amount in a transverse direction to adjust a frameless glass door in a doorframe.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
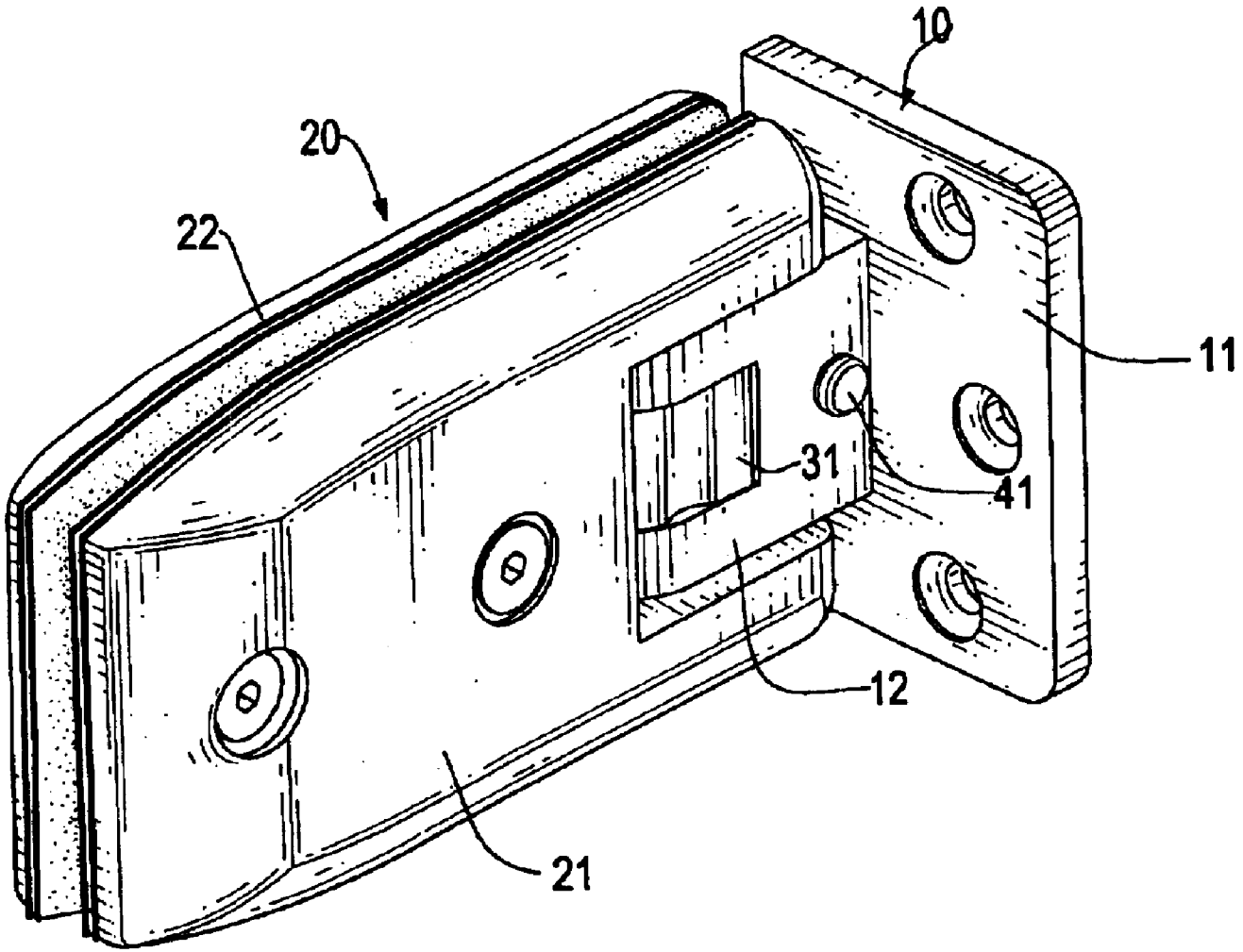
FIG. 1 is a perspective view of a frameless glass door hinge in accordance with the present invention.
Figure 2:
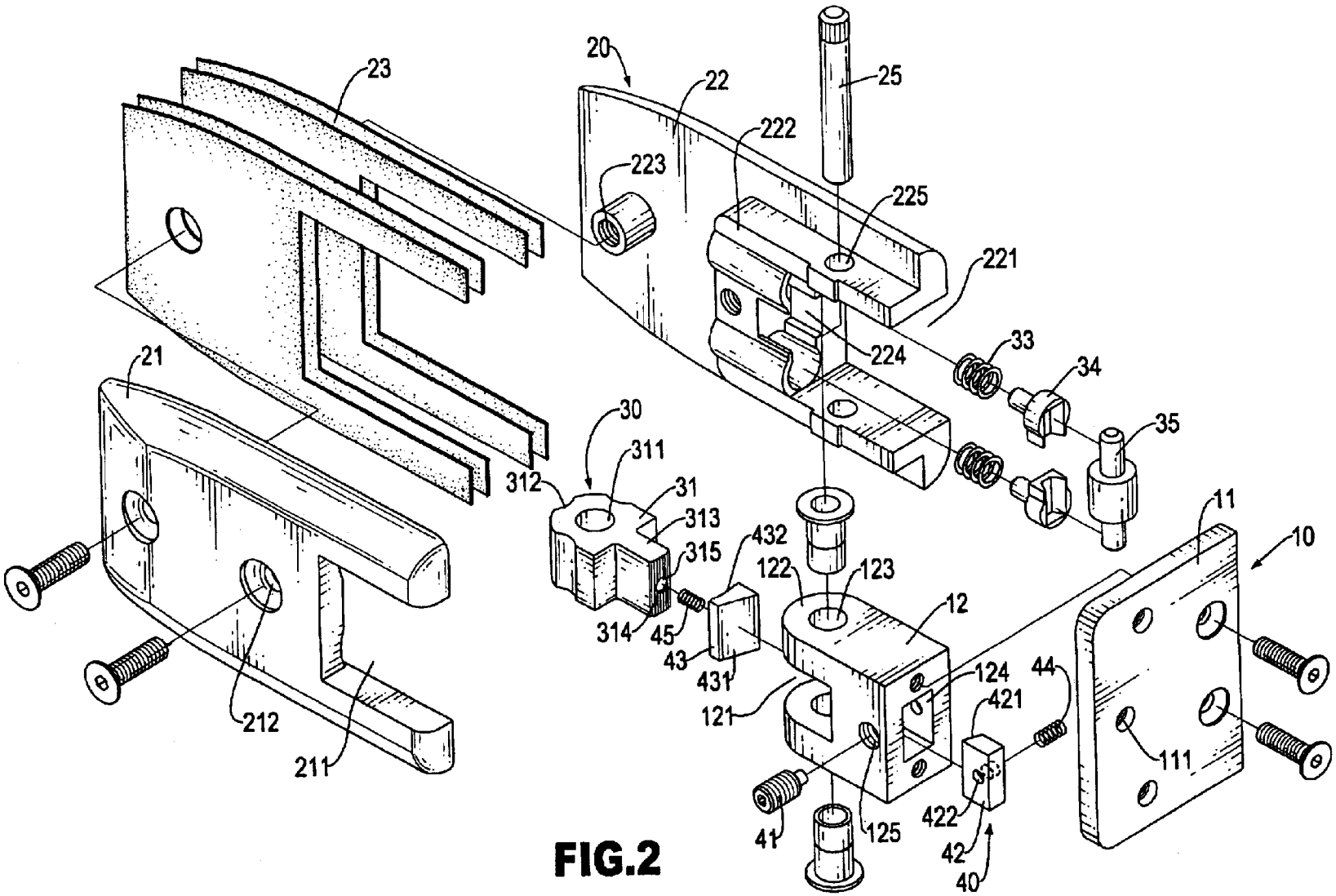
FIG. 2 is an exploded perspective view of a frameless glass door hinge in FIG. 1.

With reference to FIGS. 1 and 2, a frameless glass door hinge comprises a mounting device (10), a hinge assembly (20), an internal doorstop (30) and an angle adjustment device (40).

The mounting device (10) comprises a bracket leaf (11), threaded bolts (not numbered), a doorstop bracket (12), a central hinge pin (25) and a bushing (not numbered). The bracket leaf (11) comprises a front surface (not numbered), a rear surface (not numbered) and countersunk holes (not numbered). Two countersunk holes extend from the rear surface to the front surface of the bracket leaf (11), and three countersunk holes extend from the front surface to the rear surface of the bracket leaf (11).

The doorstop bracket (12) comprises a bracket body (not numbered) and two ears (122). The doorstop bracket (12) has a rectangular rear surface (not numbered), two threaded holes (not numbered), a rectangular through hole (124), a left side (not numbered), a threaded setscrew hole (125), a blind spring hole (not numbered), a front (not numbered), a top (not numbered) and a bottom (not numbered). The two threaded holes are formed in the rear surface of the bracket body respectively above and below the rectangular thorough hole (124). The threaded setscrew hole (125) is formed through the left side of the doorstop bracket (12) and communicates with the rectangular through hole (124). The rectangular through hole (124) has a right inner surface (not numbered), and the blind spring hole (not numbered) is formed in the right inner surface of the rectangular through hole (124). The two ears (122) are formed on and extend from the top and bottom of the front of the doorstop bracket (12), respectively to form a head gap (121) between the two ears (122). A pivot hole (123) is formed vertically through the two ears (122).

The bushing has an upper segment (not numbered) and a lower segment (not numbered). Each segment of the bushing has an end flange (not numbered) and a shaft (not numbered), and the shafts of the bushing segments are rotatably and respectively mounted in the pivot holes (123) toward each other. The central hinge pin (25) is a cylindrical shaft and has an upper end (not numbered) and a lower end (not numbered). Flutes (not numbered) are formed on the upper end of the central hinge pin (25).

The angle adjustment device (40) comprises a setscrew (41), an adjustment block (42), a lock (43), coil springs (44, 45). The setscrew (41) has an exterior end (not numbered), an interior end (not numbered), an exterior thread (not numbered) and an adjustment head (not numbered). The adjustment head has a significantly smaller diameter than the exterior thread, and the setscrew (41) screws into the setscrew hole (125) in the doorstop bracket (12). The adjustment block (42) has a left side (not numbered), a right side (not numbered) and an inclined face (421). The inclined face is between the left and right sides and faces forward. The left side has a blind contact hole (422), and the right side has a blind spring hole (not numbered). The adjustment block (42) is mounted in the rectangular through hole (124) with the inclined face (421) facing forward. The coil spring (44) is mounted between the blind spring holes in the right side of the adjustment block (42) and the right inner surface of the rectangular through hole (124). Then the setscrew (41) is screwed into the setscrew hole (125) until the adjustment head seats in the contact hole (422) in the adjustment block (42).

The lock (43) has a front surface (432) and a rear surface (431). The rear surface (431) is an inclined surface, and the front surface (432) is a striated surface and has a spring hole (not shown). The lock (43) is mounted in the rectangular through hole (124), and the inclined surface abuts the inclined surface of the adjustment block (42).

Figure 3:
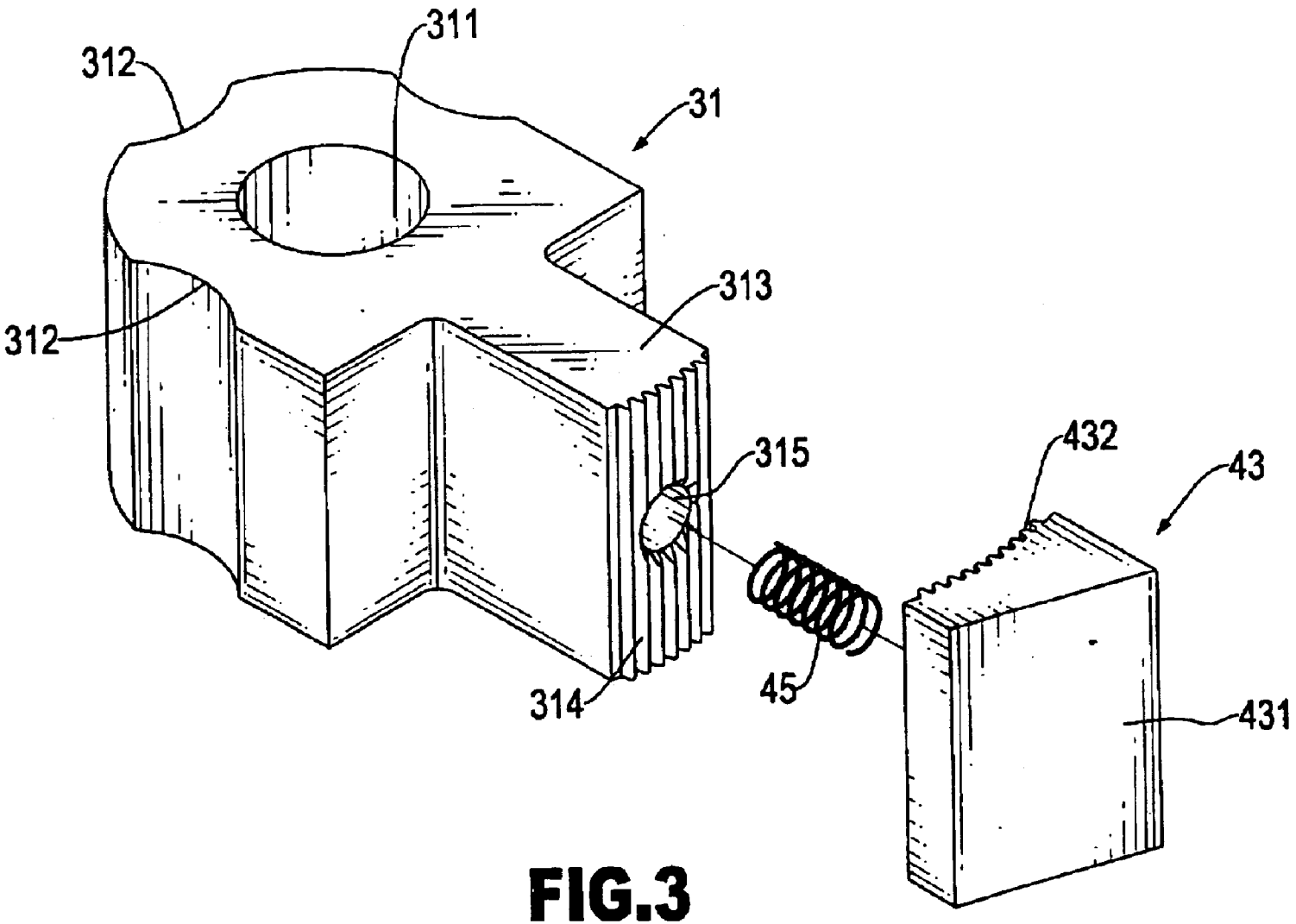
FIG. 3 is a an exploded perspective view of a lock and an internal doorstop for a frameless glass door hinge in FIG. 2.
Figure 4:
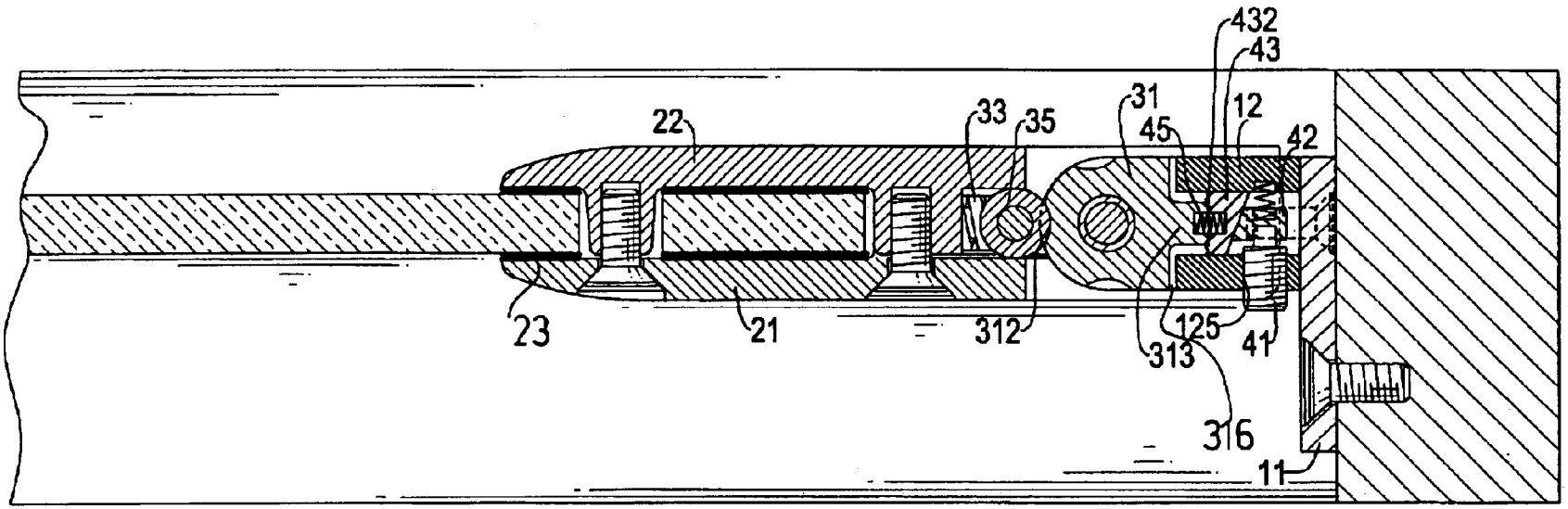
FIG. 4 is a cross sectional top plan view of a frameless glass door hinge in FIG. 2, wherein a glass door is securely connected to a door frame by the hinge assembly.

With further reference to FIG. 3, the internal doorstop (30) comprises a head (31), coil springs (33), two holders (34) and a stop rod (35). The head (31) comprises a central pivot hole (311), a round surface (not numbered), a rear surface (not numbered), detents (312), a neck (313), a striated surface (314) and a spring hole (315). The detents (312) are formed parallel on the round surface (not numbered). The central pivot hole (311) extends vertically through the head (31). The neck (313) has a proximal end and a distal end and extends from the rear surface of the head (31). The striated surface (314) is a convex surface and is formed on the distal end of the neck (313). The spring hole (315) is formed on the striated surface (314). When the head (31) is mounted in the head gap (121) of the doorstop bracket (12), the two bushing segments extend through the pivot through holes (123) respectively and the central pivot hole (311). The central hinge pin (25) extends through the bushing to pivotally hold the head (31) in the head gap (121) between the ears (122) with the neck (313) extending into the rectangular through hole (124) in the bracket body. The coil spring (45) is mounted between the spring hole (315) in the striated surface (314) of the head (31) and spring hole in the front surface (432) of the lock (43). With further reference to FIG. 4, a gap (316) is formed between the head (31) and the doorstop bracket (12) when the striated surface (314) abuts the front surface (432) of the lock (43) of the lock (43). The gap (316) allows the head to pivot around the central hinge pin (25) so a frameless glass door can be aligned with a doorframe.

With reference to FIGS. 2 and 4, the stop rod (35) has a central portion (not numbered) and two ends (not numbered). The central portion has a larger diameter than the two ends. Each holder (34) has a circular shaft (not numbered) and a head (not numbered) with a transverse mounting slot (not numbered). Each transverse mounting slot has a closed end and an open end. The shafts of the holders (34) respectively extends through the coil springs (33), and the two ends of the stop rod (35) are respective mounted in the two transverse mounting slots in the holders (34) with the central portion abutting the open ends of the two transverse mounting slots in the holders (34). The central portion of the stop rod (35) is held in one of the detents (312) in the head (31) by the coil springs (33).

The hinge assembly (20) has a right hinge leaf (22), a left hinge leaf (21), threaded bolts (not numbered) and four rubber gaskets (23). The right hinge leaf (22) comprises two arms (not numbered), an outer surface (not shown), an inside surface (not numbered) and a bracket (222). A hollow stud (223) protrudes from the inside surface and has an inner thread (not numbered). A U-shaped gap (221) is formed between the arms of the right hinge leaf (22). The bracket (222) comprises a central body (not numbered) and two flat arms (not numbered). The arms are formed integrally and longitudinally with and extend perpendicular from the right hinge leaf (22) and bound the gap (221). Two pivot holes (225) are formed respectively through the two flat arms of the bracket (222). The flutes on the central hinge pin (25) firmly hold the central hinge pin (25) in the pivot holes (225). The center body has a threaded hole (not numbered) and a right hinge leaf recess (224). The right hinge leaf recess (224) has a rectangular space (not numbered) and two cylindrical spaces (not numbered). The two coil springs (33) are respectively mounted in the cylindrical spaces in the right hinge leaf recess (224). The shafts of the two holders (34) respectively extend through the two coil springs (33) and mounted in the cylindrical spaces. Two of the rubber gaskets are shaped to correspond to the inside surface on the right hinge leaf (22) and are attached to the inside surface of the right hinge leaf (22).

The left hinge leaf (21) comprises an inside surface (not shown), an outer surface (not numbered), countersunk holes (212), two arms (not numbered) and a U-shaped gap (211). The U-shaped gap (not numbered) is formed between 11 the two arms. The countersunk holes (212) extend from the outer surface to the inside surface of the left hinge leaf (21). The other two rubber gaskets (23) are shaped to correspond to the inside surface of the left hinge leaf (21) and are mounted on the inside surface. The threaded bolts pass through the countersunk holes (212), are securely screwed respectively into the inner thread in the stud (223) and the threaded hole in the central body and connect the right and left hinge leaves (62, 61) together. The head (31) is connected to the hinge assembly (20) by the central hinge pin (25) in the gap between the two arms in the hinge assembly (20).

Figure 5:
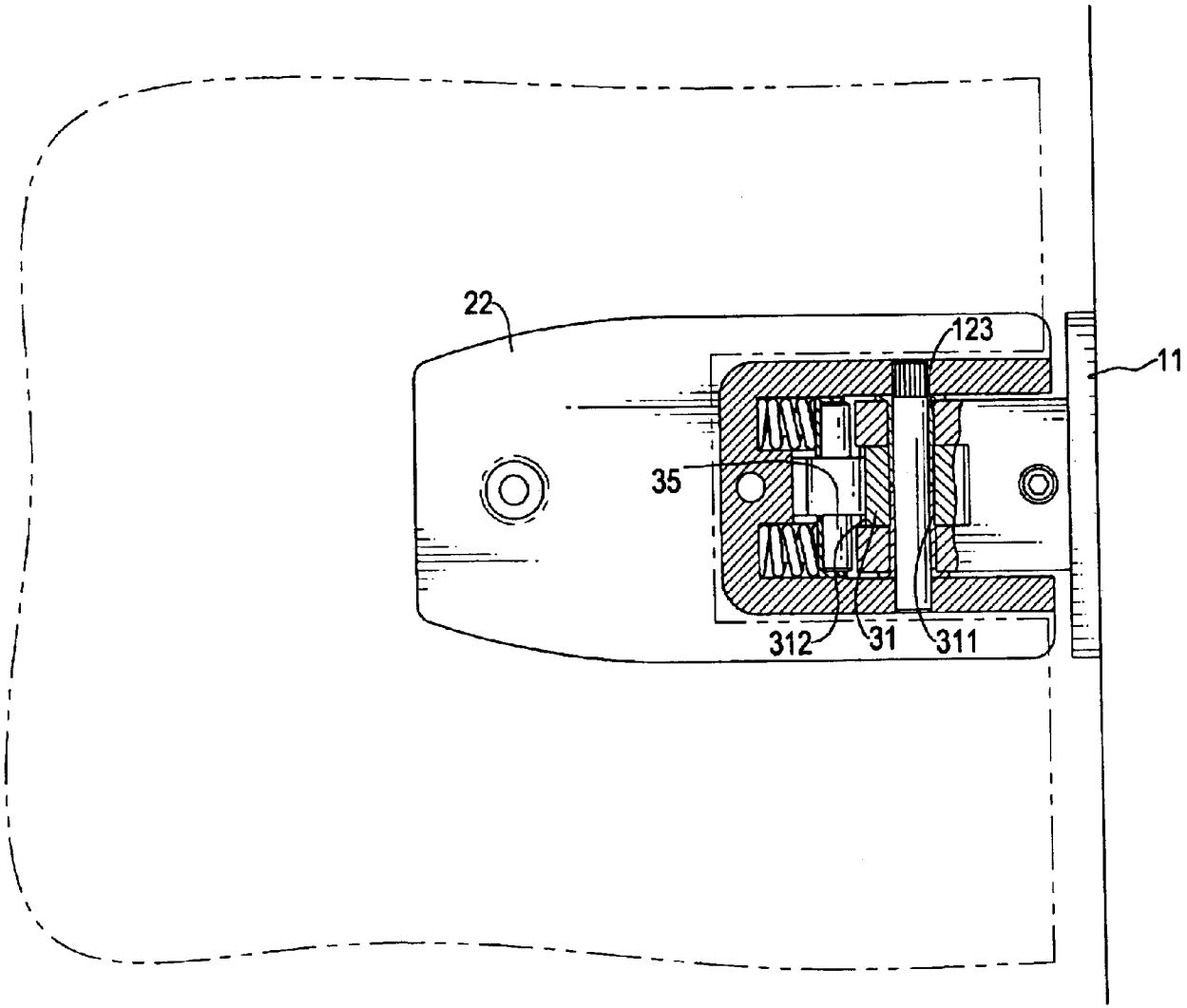
FIG. 5 is a cross sectional front plan view of a frameless glass door hinge in FIG. 2, wherein a glass door is securely connected to the door frame by the hinge assembly.

With reference to FIGS. 4 and 5, the frameless glass door hinge is attached to a doorframe (not numbered) by screwing the threaded bolts extending through the countersunk holes in the bracket leaf (11) into threaded holes (not shown) in the doorframe. A frameless door glass (not numbered) is securely mounted between the rubber gaskets of the right and left hinge body leaves (21, 22).

The central portion of the stop rod (35) mounted between the transverse mounting slots in the two holders (34) are in one of the detents (312) of the head (31) when the door is held closed or open. When the door glass is pushed, the central portion of the stop rod (35) disengages from the detents (312) in which it was held and moves with the door glass on the round surface of the head (31) until the central portion engages the adjacent detents (312). When the central portion engages another detent (312), the door glass stops and is held in position.

Figure 6:
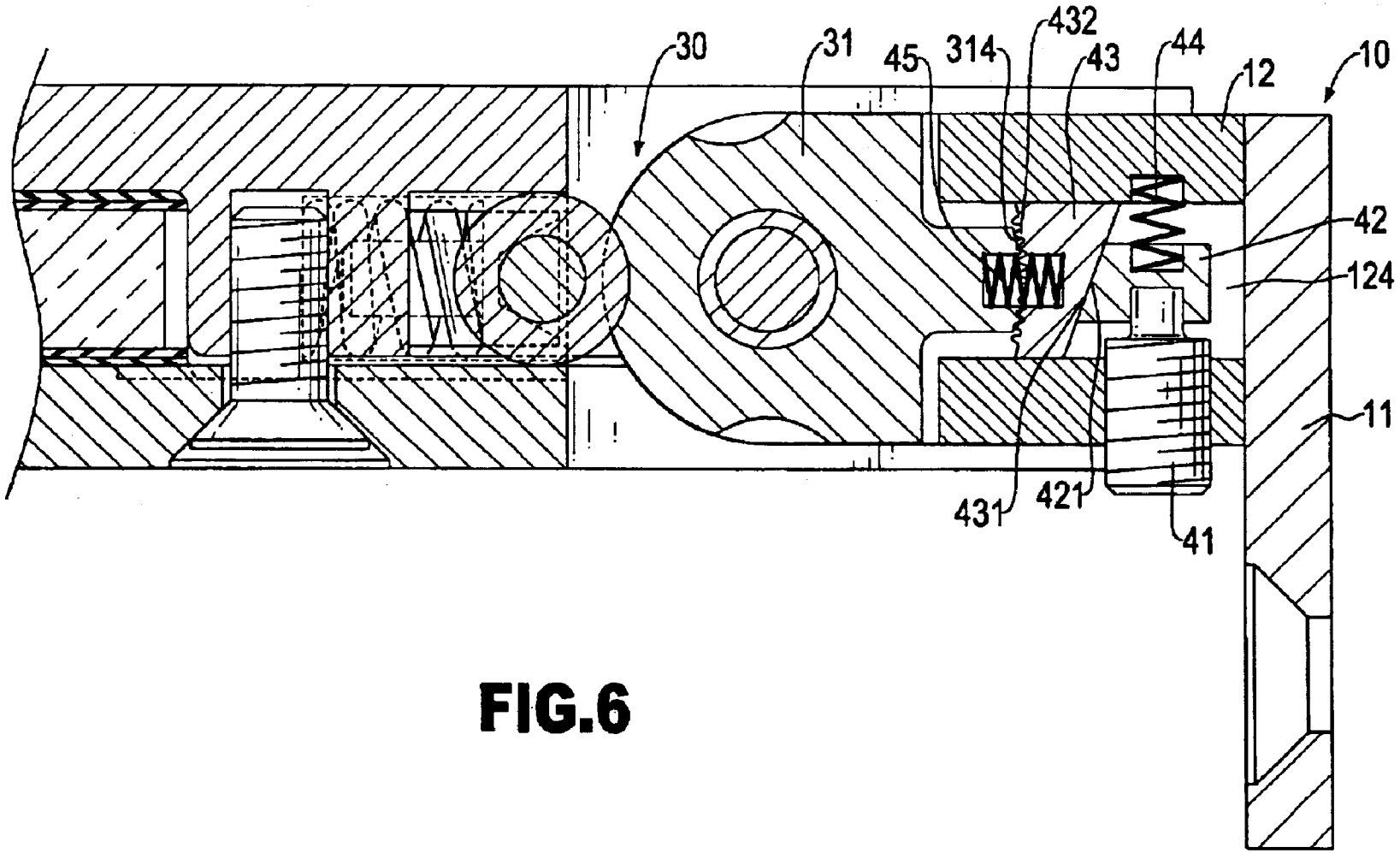
FIG. 6 is an operational top plan view of a frameless glass door hinge in FIG. 1, wherein an internal doorstop is securely attached to the angle adjustment device.
Figure 7:
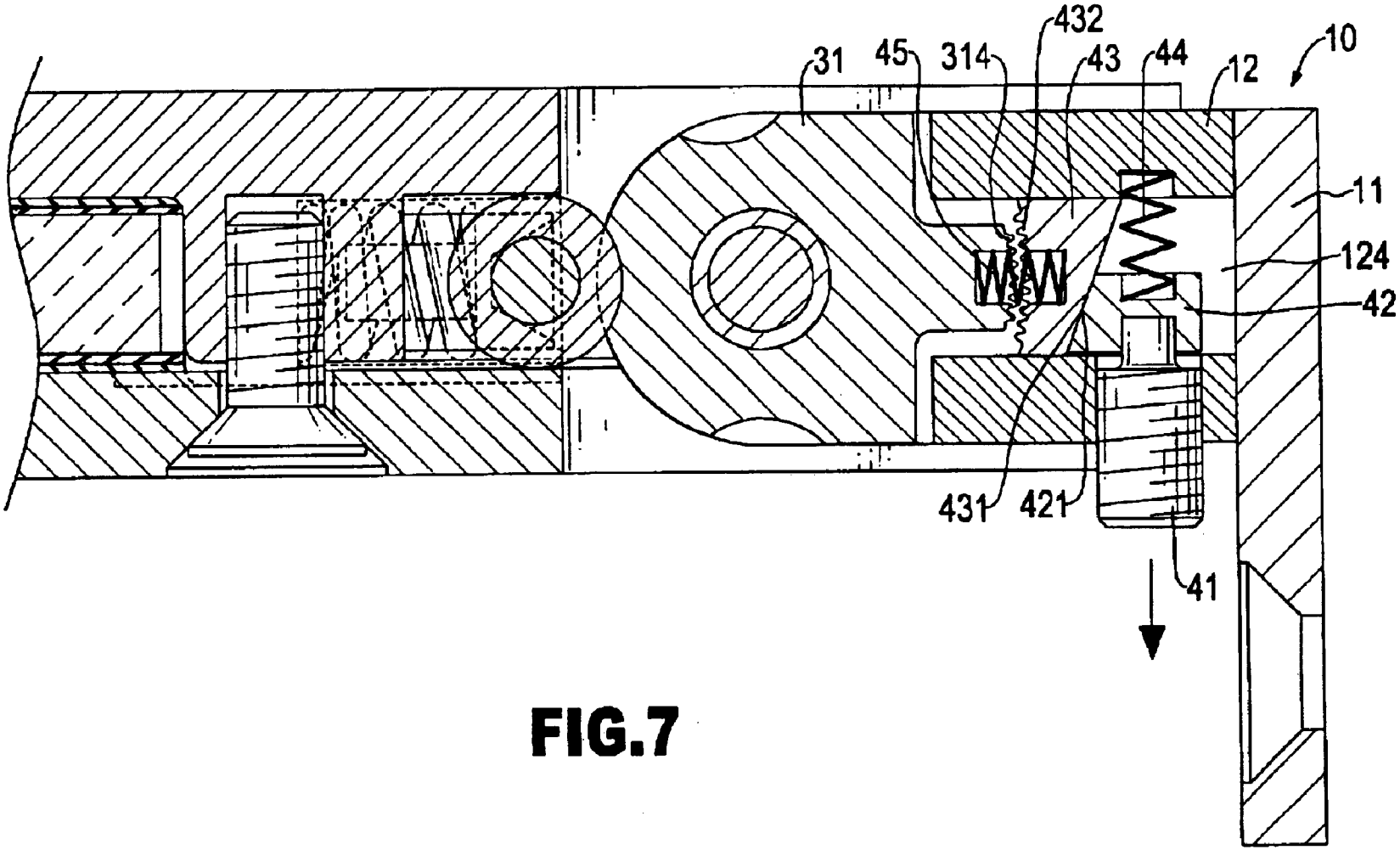
FIG. 7 is an operational top plan view of a frameless glass hinge in FIG. 1, wherein the internal doorstop is separated with the angle adjustment device.
Figure 8:
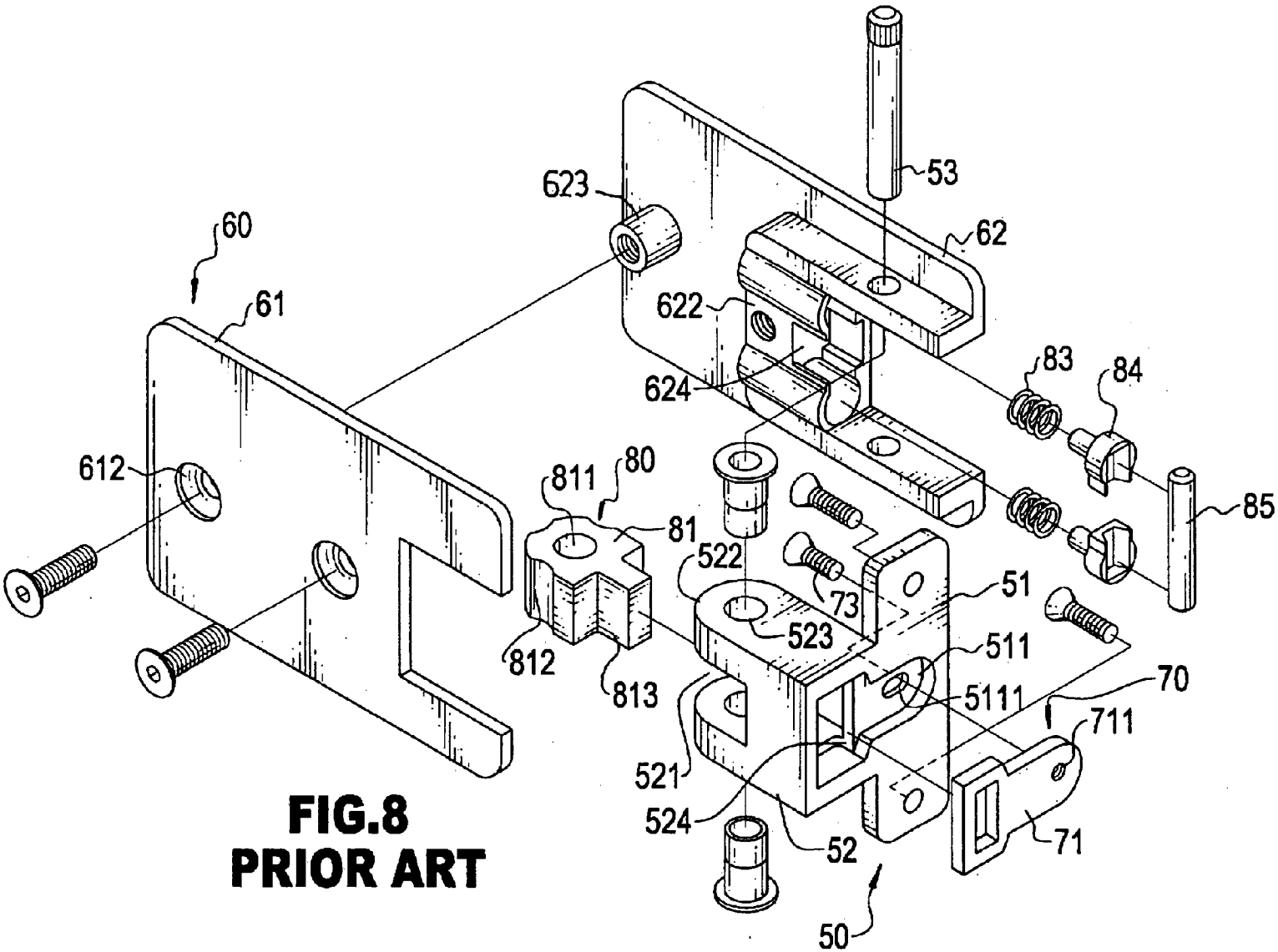
FIG.8 PRIOR ART
FIG. 8 is an exploded perspective view of a conventional frameless glass door hinge.

With further reference to FIGS. 6 and 7, when the frameless door glass is not aligned with the doorframe in a transverse direction, the setscrew (41) is screwed out of the setscrew hole (125) until the striated surface of the lock (43) disengages from the striated surface (314) on the head (31). Then the frameless glass door is aligned with the doorframe, and the setscrew (41) is screwed into the setscrew hole (125) to push the adjustment block (42) against the coil spring (44) and cause the inclined surface on the adjustment block (42) to slide along the inclined surface of the lock (43), which pushes the lock (43) toward the head (31). The striated surfaces (314,432) interlock the alignment procedure is complete.

The advantage of the frameless glass door hinge is that the door glass can be adjusted in a transverse direction through a simple and easy step by rotating the setscrew.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A frameless glass door hinge for a frameless glass door mounted in a doorframe; the frameless glass door hinge comprising a mounting device having a bracket leaf, a doorstop bracket and a bushing, wherein the bracket leaf has a front surface and a rear surface, wherein the front surface is adapted to be securely connected to the door frame;

the doorstop bracket is securely attached to the bracket leaf and comprises a bracket body having a rear rectangular surface, a rectangular through hole and a threaded setscrew hole and being securely connected to the bracket leaf, wherein the rectangular through hole has a right inner surface, and the threaded setscrew hole is formed in the bracket body and communicates with the rectangular through hole; and two ears extending from the bracket body to form a head gap between the ears and each having a pivot hole formed through the ear; and the bushing extends through the pivot holes in the ears;

an adjusting device mounted in the doorstop bracket and comprising an adjustment block, a setscrew, a lock and a first coil spring, wherein the adjustment block has a left surface facing the threaded setscrew hole in the bracket body, a right surface facing the right inner surface of the rectangular through hole and an inclined surface and is mounted in the rectangular through hole in the bracket body;

the setscrew screws into the threaded setscrew hole in the bracket body and has a free end abutting against the left surface of the adjustment block;

the first coil spring is mounted between the right surface of the adjustment block and the right inner surface of the rectangular through hole; and the lock is moveably received in the rectangular through hole and has a rear surface and a front surface, wherein the rear surface is an inclined surface abutting with the inclined surface on the adjustment block, and the front surface is a striated surface;

an internal doorstop pivotally connected to the doorstop bracket and comprising a head, a second coil spring, two third coil springs, two holders and a stop rod, wherein the head is pivotally mounted around the bushing in the head gap between the ears on the doorstop bracket and comprises a central pivot hole for the busing extending through the central pivot hole, a round surface, a rear surface, detents, a neck extending from the rear surface of the head and into the rectangular through hole in the bracket body and a striated surface, wherein the detents are formed parallel on the round surface;

the neck has a proximal end and a distal end and extends from the rear surface of the head; and the striated surface is formed on the distal end of the neck and abuts the striated front surface of the lock;

the second coil spring is mounted between the striated surfaces of the head and the front surface of the lock;

the stop rod has two ends and a circular portion selectively held in one of the detents on the head;

each of the two holders abuts against the stop rod and has a circular shaft and a head with a transverse mounting slot to received one end of the stop rod; and the third coil springs respectively abut against the heads of the holders;

a hinge assembly pivotally connected to the doorstop bracket and comprising a right hinge leaf, a left hinge leaf and a central hinge pin, wherein the right hinge leaf has two arms with a U-shaped gap formed between the two arms, and each arm has a pivot hole;

the left hinge leaf is securely connected to the right hinge leaf and has two arms with a U-shaped gap formed between two arms to accommodate the doorstop bracket in the U-shaped gap in cooperation with the U-shaped gap between the arms of the right hinge leaf; and the central hinge pin has two ends and flutes formed on one end and rotatably extends through the pivot holes in the arms of the right hinge leaf and the bushing, wherein the flutes are formed in one end of the central pivot pin engage with one of the pivot holes in the arms of the right hinge leave and securely hold the central pivot pin.

2. The frameless glass door hinge as claimed in claim 1, wherein the bracket leaf has two countersunk holes extending through the bracket leaf;

the doorstop bracket has two threaded holes formed on the rear surface of the doorstop bracket and respectively aligning with the countersunk holes in the bracket leaf; and a threaded bolt extends through each respective countersunk hole in the bracket leaf and screwed into a corresponding one of the threaded holes in the rear surface of the doorstop bracket to securely connect the doorstop bracket to the bracket leaf.

3. The frameless glass door hinge as claimed in claim 1, wherein the doorstop bracket has a blind spring hole formed in the right inner surface of the rectangular through hole;

the adjustment block has a spring hole aligning with the blind spring hole in the right inner surface of the rectangular hole; and the first coil spring has two ends respectively received in the blind spring hole in the doorstop bracket and the spring hole in the adjustment block.

4. The frameless glass door hinge as claimed in claim 1, wherein the adjustment block has a contact hole facing the threaded setscrew hole in the doorstop bracket; and the setscrew has an exterior thread formed on the free end of the setscrew and received in the contact hole in the adjustment block.

5. The frameless glass door hinge as claimed in claim 1, wherein the bushing has two hollow segments; and each segment has an end flange and a shaft rotatably mounted in one of the pivot holes in the two ears and extending into the central pivot hole in the head.

6. The frameless glass door hinge as claimed in claim 1, wherein the lock has a spring hole defined in the striated front surface;

the head has a spring hole defined in the striated surface and aligning with the spring hole in the lock; and the second coil spring has two ends respectively received in the spring holes in the striated surfaces of the head and the front surface of the lock.

7. The frameless glass door hinge as claimed in claim 6, wherein the striated surface on the head is a convex surface.

8. The frameless glass door hinge as claimed in claim 1, wherein the central portion of the stop rod has a larger diameter than the two ends of the stop rod.

9. The frameless glass door hinge as claimed in claim 8, wherein each holder has a transverse mounting slot with a closed end and an open end to receive one end of the stop rod; and the central portion of the stop rod abuts the open ends of the two transverse mounting slots.

10. The frameless glass door hinge as claimed in claim 1, wherein the shaft of each respective holder extends through one of the third coil springs.

11. The frameless glass door hinge as claimed in claim 1, wherein the right hinge leaf has an inside surface with an inner threaded stub protruding from the inside surface;

the right hinge leaf has a bracket with a central body and two flat arms formed on the inside surface;

the central body has a threaded hole and a right hinge leaf recess;

the left hinge leaf has an inside surface and multiple countersunk holes respectively aligning with the inner threaded stub and the threaded hole in the central body of the bracket of the right hinge leaf; and a threaded bolt extends through each respective countersunk hole in the left hinge leave and screws into a corresponding one of the inner threaded stud and the threaded hole on the central body of the bracket on the right hinge leaf.

12. The frameless glass door hinge as claimed in claim 11, wherein the central body has two cylindrical spaces;

the third coil springs are respectively mounted in the cylindrical spaces in the central body; and the two shafts of the two holders respectively extend into the third coil springs and are mounted in the cylindrical spaces.

13. The frameless glass door hinge as claimed in claim 11 further comprising two rubber gaskets securely attached to the inside surface of the right hinge leaf.

14. The frameless glass door hinge as claimed in claim 11 further comprising two rubber gaskets securely attached to the inside surface of the left hinge leaf.

* * * * *